US010923005B2

(12) United States Patent
Wei et al.

(10) Patent No.: US 10,923,005 B2
(45) Date of Patent: Feb. 16, 2021

(54) DISPLAY PANEL AND DISPLAY APPARATUS

(71) Applicant: Xiamen Tianma Micro-Electronics Co., Ltd., Xiamen (CN)

(72) Inventors: Rucuo Wei, Xiamen (CN); Qiang Tian, Xiamen (CN); Xiangzi Kong, Xiamen (CN); Bojia Lv, Xiamen (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 86 days.

(21) Appl. No.: 16/404,367

(22) Filed: May 6, 2019

(65) Prior Publication Data

US 2020/0211428 A1 Jul. 2, 2020

(30) Foreign Application Priority Data

Dec. 28, 2018 (CN) ..... 2018 1 1623294

(51) Int. Cl.

| | |
|---|---|
| ***G09G 3/06*** | (2006.01) |
| ***G09G 3/00*** | (2006.01) |
| ***G09G 3/3225*** | (2016.01) |
| ***G09G 3/3266*** | (2016.01) |
| ***G09G 3/3291*** | (2016.01) |

(52) U.S. Cl.

CPC ..... *G09G 3/006* (2013.01); *G09G 3/3225* (2013.01); *G09G 3/3266* (2013.01); *G09G 3/3291* (2013.01); *G09G 2310/08* (2013.01); *G09G 2330/12* (2013.01)

(58) Field of Classification Search

CPC ... G01R 31/317; G01R 31/2829; G09G 3/006

See application file for complete search history.

(56) References Cited

U.S. PATENT DOCUMENTS 6,218,201 B1 * 4/2001 Plangger ..... G09G 3/006 324/532
9,472,131 B2 * 10/2016 Ghaderi ..... G09G 3/006
2016/0252764 A1 * 9/2016 Zhao ..... G02F 1/1345 349/139

FOREIGN PATENT DOCUMENTS

CN 107229165 A 10/2017

* cited by examiner

*Primary Examiner* — Reena Aurora

(74) *Attorney, Agent, or Firm* — Christensen O'Connor Johnson Kindness PLLC

(57) ABSTRACT

The present disclosure relates to the field of display technologies and provides a display panel and a display apparatus for improving the accuracy of test signals acquired in a VT test. The display panel includes a base substrate. The base substrate is provided with a plurality of test leads in a non-display area, and the plurality of test leads includes a circuit board lead and a test point lead. The base substrate is also provided with a test pad and a test circuit board pin in the non-display area. The circuit board lead is electrically connected to the test circuit board pin, the test point lead is electrically connected to the test pad, and the test pad being reused as a circuit board alignment mark.

20 Claims, 13 Drawing Sheets

DISPLAY PANEL AND DISPLAY APPARATUS

CROSS-REFERENCE TO RELATED APPLICATIONS

The present disclosure claims priority to Chinese Patent Application No. 201811623294.8, filed on Dec. 28, 2018, the content of which is incorporated herein by reference in its entirety.

TECHNICAL FIELD

The present disclosure relates to the technical field of display technologies, and in particular, to a display panel and a display apparatus.

BACKGROUND

A display panel may be defective during the production process, and if the defects are discovered after an Integrated Circuit (IC) is attached to the display panel, the IC cannot be used again. Therefore, a Visible Test (VT) is required to be performed before the IC is attached to the display panel, i.e., simulating the lighting of the display panel by IC to perform the test.

Currently, it is required to perform a VT test on the display panel with a test circuit board. The display panel to be tested by the VT test includes a pin for the test circuit board. Firstly, the test circuit board is pressed onto the pin on the display panel to electrically connect the test circuit board and the display panel. Then an input signal is provided to the display panel through the test circuit board, and at the same time, an output signal from the display panel is acquired through the test circuit board. During the pressing of the test circuit board, a poor contact may occur, which adversely affects the accuracy of the test signal acquired through the test circuit board.

SUMMARY

Embodiments of the present disclosure provide a display panel and a display apparatus, which can improve the accuracy of the test signal acquired in the VT test.

In a first aspect, the embodiments of the present disclosure provide a display panel having a non-display area and a display area. The display panel includes a base substrate. The base substrate is provided with a plurality of test leads in the non-display area. The plurality of test leads includes a circuit board lead and a test point lead. The base substrate is further provided with a test pad and a test circuit board pin in the non-display area. The test circuit board pin is electrically connected to the circuit board lead, and the test pad is electrically connected to the test point lead and reused as a circuit board alignment mark.

In a second aspect, the embodiments of the present disclosure provide a display apparatus including the display panel according to the first aspect.

BRIEF DESCRIPTION OF DRAWINGS

In order to more clearly illustrate technical solutions of embodiments of the present disclosure, the accompanying drawings used in the embodiments are briefly described below. The drawings described below are merely a part of the embodiments of the present disclosure.

DESCRIPTION OF EMBODIMENTS

The purpose of the embodiments of the present disclosure will be clearly and completely described in conjunction with the drawings in the embodiments of the present disclosure. The described embodiments are merely some embodiments of the present disclosure, but not all of the embodiments. All other embodiments obtained by those skilled in the art based on the embodiments of the present disclosure without creative efforts shall fall within the scope of the present disclosure.

The terms used in the embodiments of the present disclosure are merely for the purpose of describing particular embodiments, but not intended to limit the present disclosure. Unless otherwise specified in the context, the singular form expressions "a", "an", "the" and "said" used in the embodiments and the pending claims of the present disclosure also represent a plural form.

Figure 1:
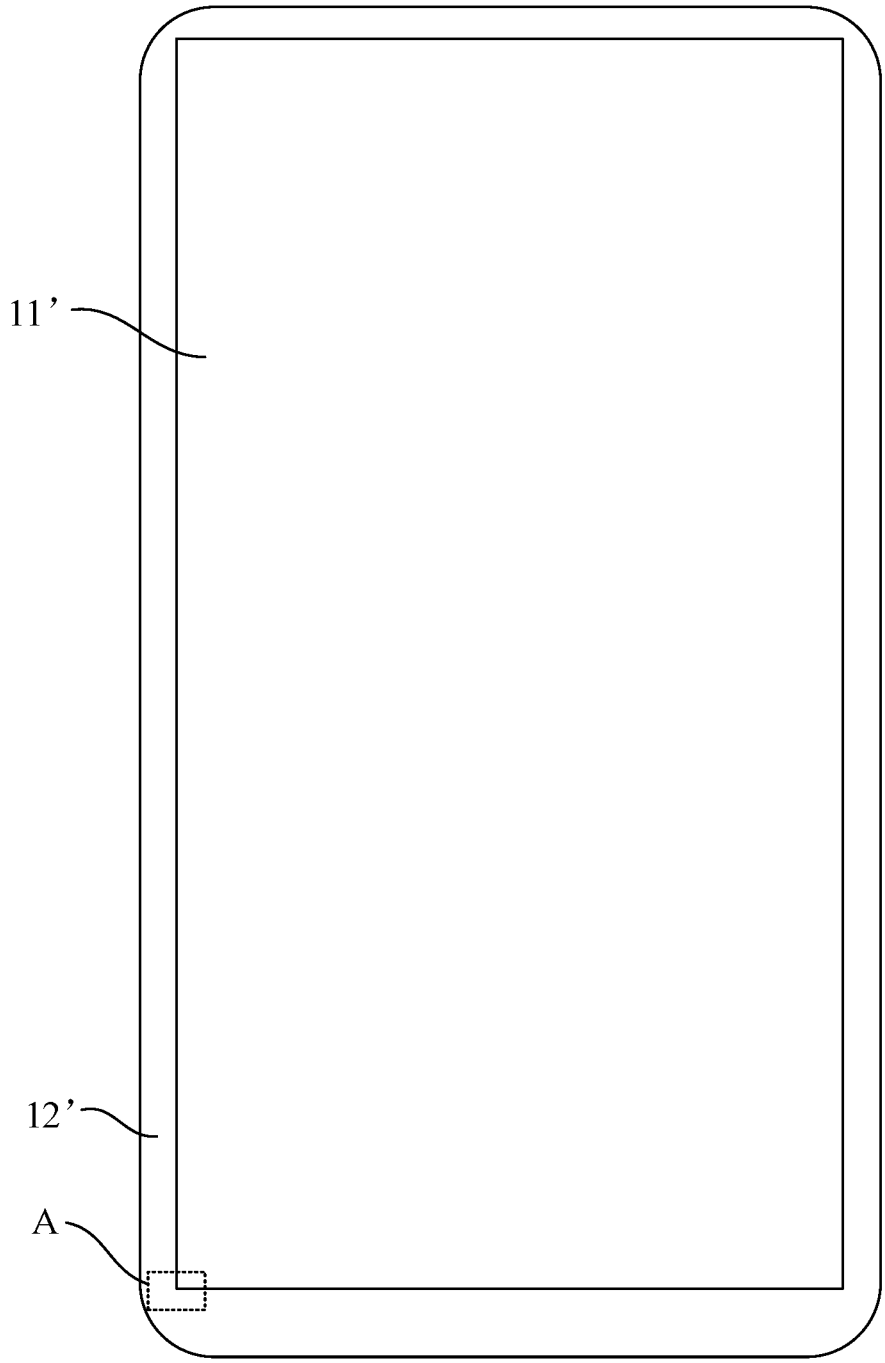
FIG. 1 (Prior Art)
FIG. 1 is a structural schematic diagram of a display panel in the related art.
Figure 2:
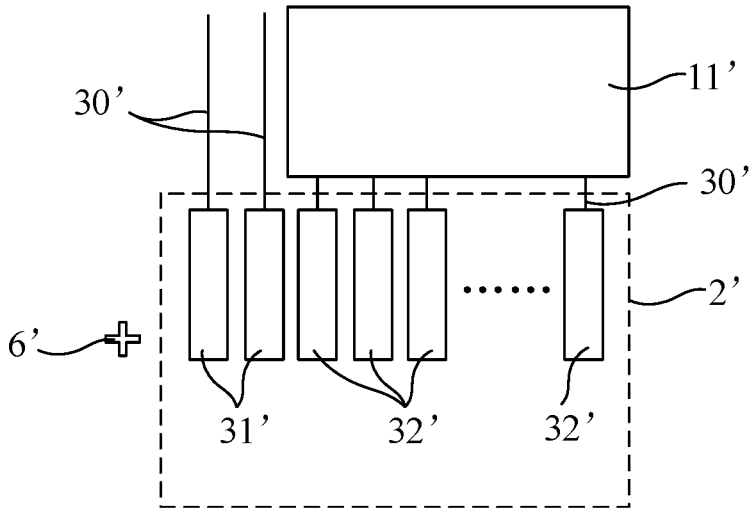
FIG. 2 (Prior Art)
FIG. 2 is a partially enlarged structural schematic diagram of an area A shown in FIG. 1.
Figure 3:
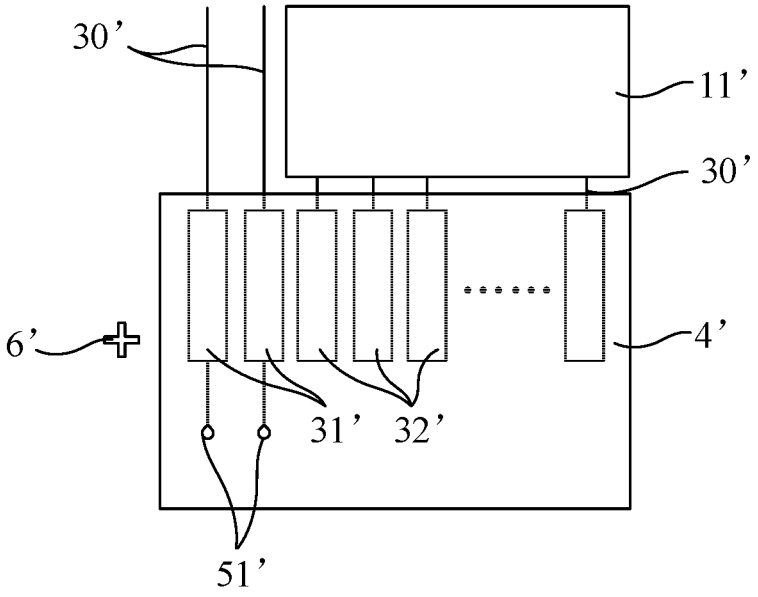
FIG. 3 (Prior Art)
FIG. 3 is a structural schematic diagram of the display panel shown in FIG. 2 when a test circuit board is pressed.
Figure 4:
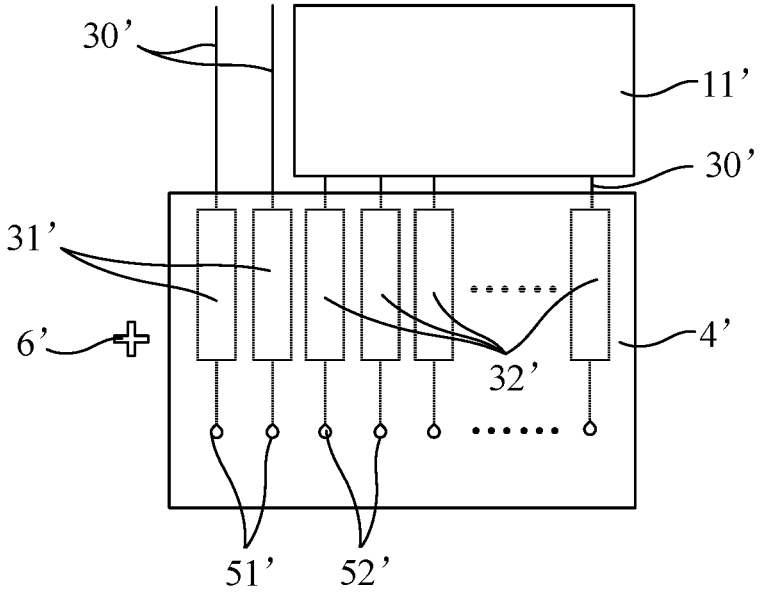
FIG. 4 (Prior Art)
FIG. 4 is another structural schematic diagram of the display panel shown in FIG. 2 when a test circuit board is pressed.

In order to further illustrate the beneficial effects of the embodiments of the present disclosure, before describing the embodiments of the present disclosure in detail, the process of discovering the problems in the related art is first described. The display panel known in the related art are shown in FIGS. 1 to 3, in which FIG. 1 is a structural schematic diagram of a display panel in the related art, FIG. 2 is a partially enlarged structural schematic diagram of the area A shown in FIG. 1, and FIG. 3 is a structural schematic diagram of the display panel shown in FIG. 2 when a test circuit board is pressed. The display panel has a display area 11' and a non-display area 12'. A VT test scheme is conducted as follows. A test pressed area 2' is provided in the non-display area 12' outside the display area 11'. An output test pin 31' and an input test pin 32' are provided in the test pressed area 2', and the output test pin 31' and the input test pin 32' both are electrically connected to the test signal lead 30', through which the signal required to be input to the display panel is electrically connected to the input test pin 32' and the signal required to be fed back in the display panel is electrically connected to the output test pin 31'. A test circuit board 4' is pressed and connected to the test pins in the test pressed area 2', and the test circuit board 4' is provided with output test pads 51' corresponds to the output test pins 31' in one-to-one correspondence. During the VT test, an external input signal, as an input signal, is provided to the input test pin 32' through the line of the test circuit board 4', so as to drive the display panel to work and emit light. An output test signal from the display panel is acquired by the output test pad 51' on the surface of the test circuit board 4'. Thus, on the one hand, whether the display panel is defective is determined based on the lighting state, and on the other hand, the defect can be further diagnosed on basis of the input signal and the acquired output test signal. However, when pressing the test circuit board 4' and the display panel together, poor pressing may occur and thus result in poor electrical connection between the output test pin 31' and the test circuit board 4', which adversely affects the accuracy of the test signal acquired by the test circuit board 4'. FIG. 4 is another structural schematic diagram of the display panel of FIG. 2 when a test circuit board is pressed. As shown in FIG. 2 and FIG. 4, another VT test scheme is based on the former test scheme, in which an input test pad 52' is additionally disposed on the surface of the test circuit board 4' and electrically connected to the lead on the display panel to which the input test pin 32' is connected. During the VT test, the actual signal on the corresponding lead of the display panel can also be acquired by the input test pad 52', such that the difference between the actual signal and the input signal can be determined. Similarly, it is also possible that the accuracy of the actual signal acquired by the input test pad 52' is poor due to the poor pressing of the test circuit board 4' and the display panel (e.g., due to poor electrical connection between the test circuit board 4' and the display panel). Further, the non-display area of the display panel is provided with an alignment mark 6' for alignment when the test circuit board 4' is pressed.

Figure 5:
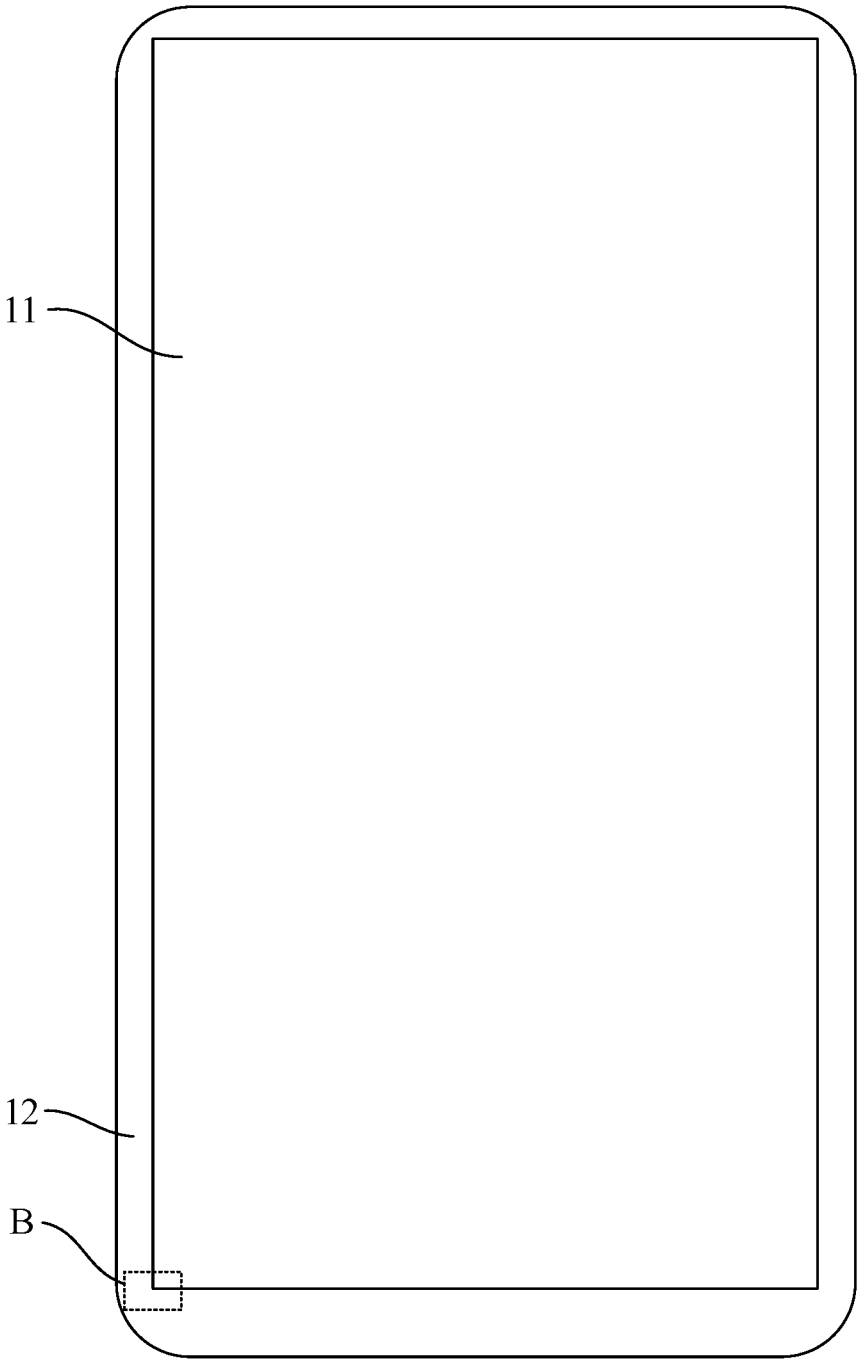
FIG. 5 is a structural schematic diagram of a display panel according to an embodiment of the present disclosure.
Figure 6:
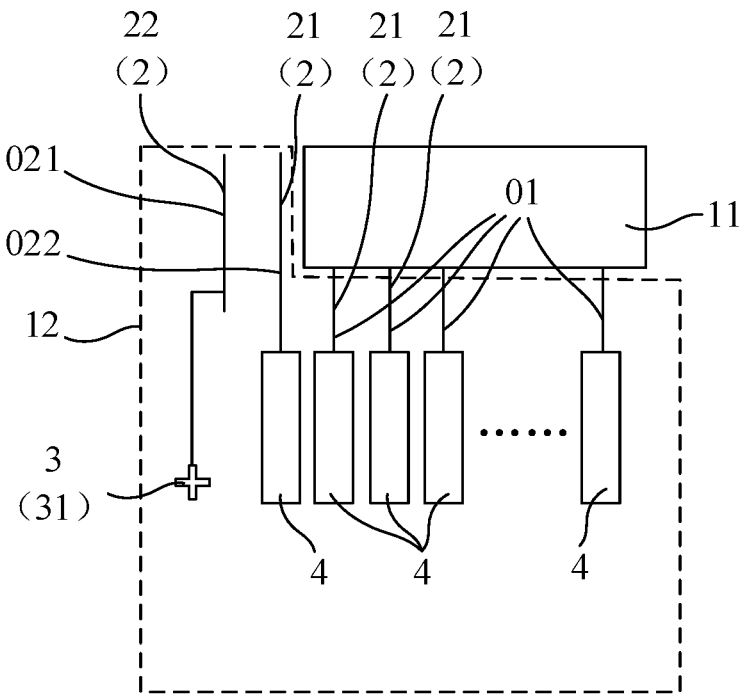
FIG. 6 is a partially enlarged structural schematic diagram of an area B shown in FIG. 5.
Figure 7:
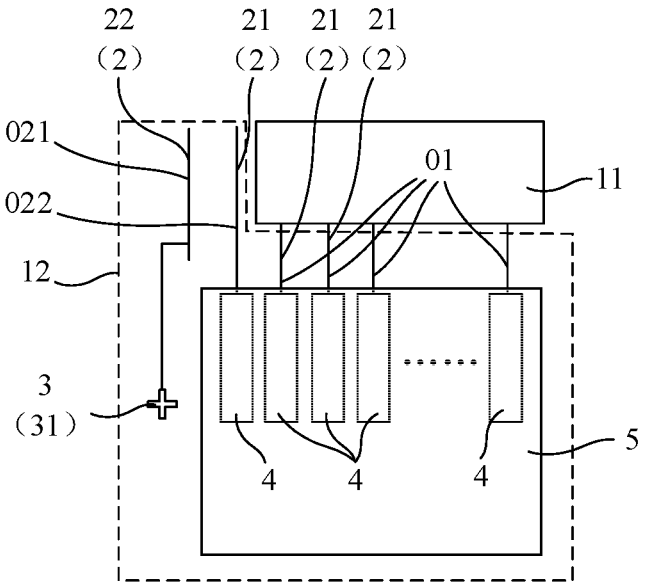
FIG. 7 is a structural schematic diagram of the display panel shown in FIG. 6 when a test circuit board is pressed.

FIG. 5 is a structural schematic diagram of a display panel according to an embodiment of the present disclosure, FIG. 6 is a partially enlarged structural schematic diagram of an area B shown in FIG. 5, and FIG. 7 is a structural schematic diagram of the display panel shown in FIG. 6 when a test circuit board is pressed. The embodiment of the present disclosure as shown in FIGS. 5 to 7 provides a display panel having a display area 11 and a non-display area 12. The display panel includes a base substrate, which is provided with a plurality of test leads 2 in the non-display area 12. The plurality of test leads 2 includes a circuit board lead 21 and a test point lead 22. The base substrate is further provided with a test pad 3 and a test circuit board pin 4 in the non-display area 12. The circuit board lead 21 is electrically connected to the test circuit board pin 4, the test point lead 22 is electrically connected to the test pad 3, and the test pad 3 is reused as a circuit board alignment mark.

During the VT test, a test circuit board 5 is pressed and connected to the test circuit board pin 4 on the display panel. During pressing, the circuit board alignment mark (the test pad 3) is used for alignment, so as to achieve a good electrical connection between the test circuit board 5 and the test circuit board pin 4. After the pressing connection of the test circuit board 5 is completed, the external input signal transmits an input signal to an input test pin of the test circuit board pin 4 through the line of the test circuit board 5, so as to drive the display panel to work and emit light. At this time, the lighting state of the display panel can be used to determine a presence of a display defect. At the same time, the output test signal of the display panel can be acquired by the test pad 3, which is further used to diagnose the defect.

In the display panel according to the embodiment of the present disclosure, a part of the plurality of test leads is used as the test point lead electrically connected to the test pad integrated on the display panel, and the test pad is reused as a circuit board alignment mark in the meantime. Therefore, it is not necessary to include the test pad on the test circuit board, and the test signal is acquired by the test pad outside the circuit board, such that the test signal is no longer acquired through the test circuit board, thereby improving the accuracy of the test signal acquired in the VT test. In addition, since at least a part of the test pad and the line are directly disposed on the display panel, the complexity and space occupation of the wirings in the test circuit board are reduced. Moreover, as the test pad is reused as a circuit board alignment mark, it is unnecessary to provide a corresponding test circuit board pin on the display panel, thereby reducing the space occupied by the test circuit board on the display panel.

As shown in FIGS. 6 and 7, the circuit board lead 21 includes an input signal lead 01, the test point lead 22 includes a first output test lead 021, the test pad 3 includes a first test pad 31, and the first output test lead 021 is electrically connected to the first test pad 31.

The input signal lead 01 is used to connect the test circuit board 5, such that an input signal required for the VT test can be provided through the test circuit board 5 and the output test signal can be acquired through the first test pad 31. Since the output test signal is a test signal that must be acquired, the test pad corresponding to the output test signal is preferentially placed outside the test circuit board and reused as a circuit board alignment mark.

As shown in FIGS. 6 and 7, the circuit board lead 21 further includes a second output test lead 022. That is, the structure shown in FIGS. 6 and 7 includes two kinds of output test leads, and the first output test lead 021 is electrically connected to the test pad 3 outside the test circuit board, and simultaneously reused as a circuit board alignment mark. The second output test lead 022 is electrically connected to the corresponding test circuit board pin 4, and thus electrically connected to the test circuit board 5 through the test circuit board pin 4. A corresponding test pad (not shown) on the test circuit board is disposed on the test circuit board 5. During the VT test, one kind of output test signal is acquired by the first test pad 31 located outside the test circuit board 5, and another kind of output test signal is acquired by the test pad located on the test circuit board 5.

Figure 8:
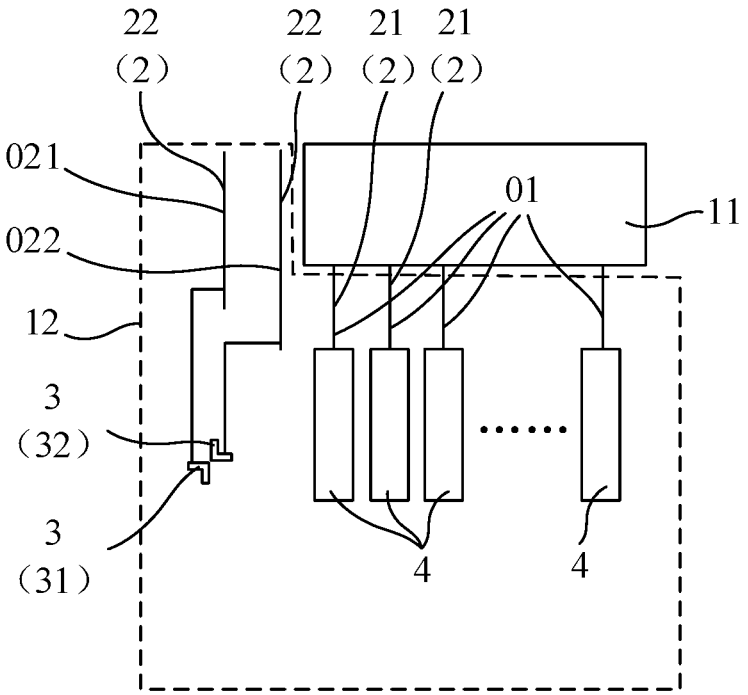
FIG. 8 is another partially enlarged structural schematic diagram of the area B shown in FIG. 5.
Figure 9:
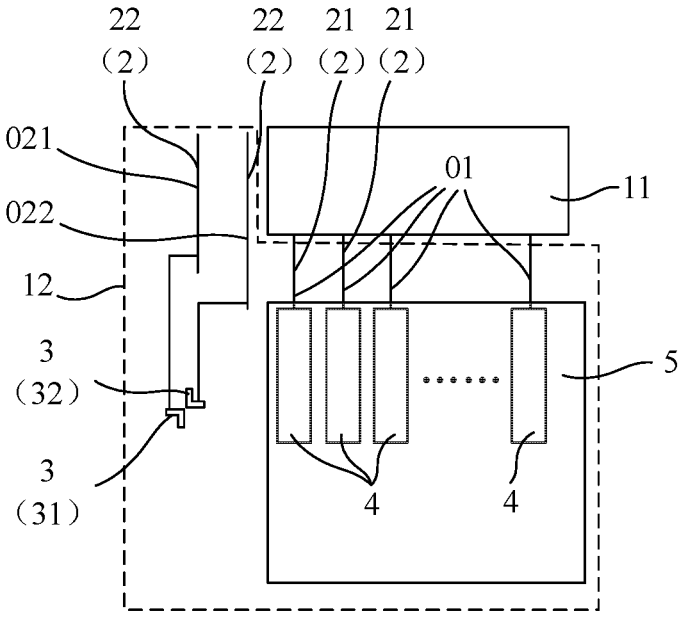
FIG. 9 is a structural schematic diagram of the display panel shown in FIG. 8 when a test circuit board is pressed.

FIG. 8 is another partially enlarged structural schematic diagram of the area B as shown in FIG. 5, and FIG. 9 is a structural schematic diagram of the display panel of FIG. 8 when a test circuit board is pressed. As shown in FIG. 8 and FIG. 9, the test point lead 22 further includes a second output test lead 022, the test pad 3 further includes a second test pad 32, and the second output test lead 022 is electrically connected to the second test pad 32.

The structure shown in FIGS. 8-9 differs from that shown in FIGS. 4-5 in that the first output test lead 021 and the second output test lead 022 are respectively electrically connected to the first test pad 31 and the second test pad 32 outside the test circuit board 5.

As shown in FIG. 8 and FIG. 9, the first test pad 31 and the second test pad 32 are spaced apart and reused as the same circuit board alignment mark. The first test pad 31 and the second test pad 32 respectively serve as two parts of the same circuit board alignment mark, which can further reduce the space occupied by the VT test circuit on the display panel.

As shown in FIG. 8 and FIG. 9, the first test pad 31 includes a first line segment and a second line segment, and the first line segment and the second line segment are connected and form a perpendicular angle. The second test pad 32 includes a third line segment and a fourth line segment, and the third line segment and the fourth line segment are connected to form a perpendicular angle. The perpendicular angle of the first test pad 31 is against the perpendicular angle of the second test pad 32, so that the first test pad 31 and the second test pad 32 form a cross-shaped alignment mark, which can effectively achieve the alignment function.

Figure 10:
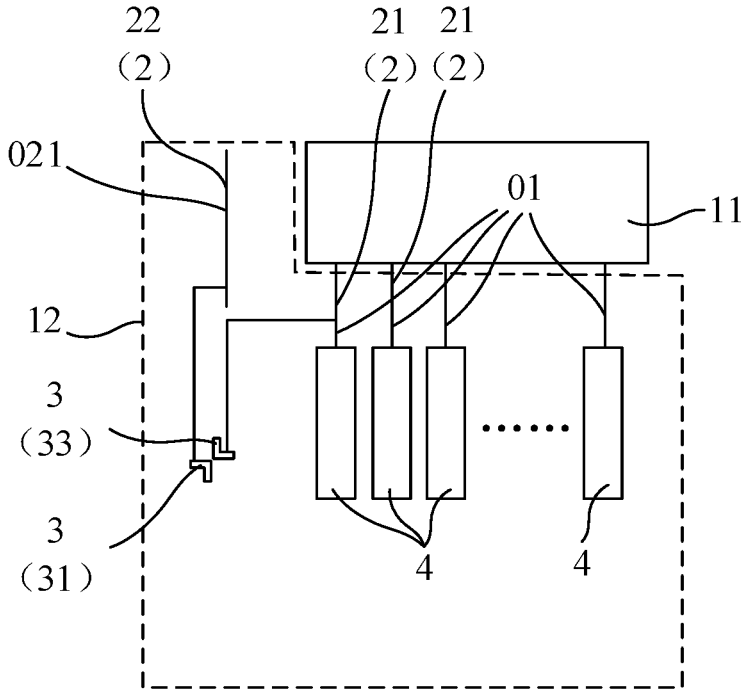
FIG. 10 is another partially enlarged structural schematic diagram of the area B shown in FIG. 5.
Figure 11:
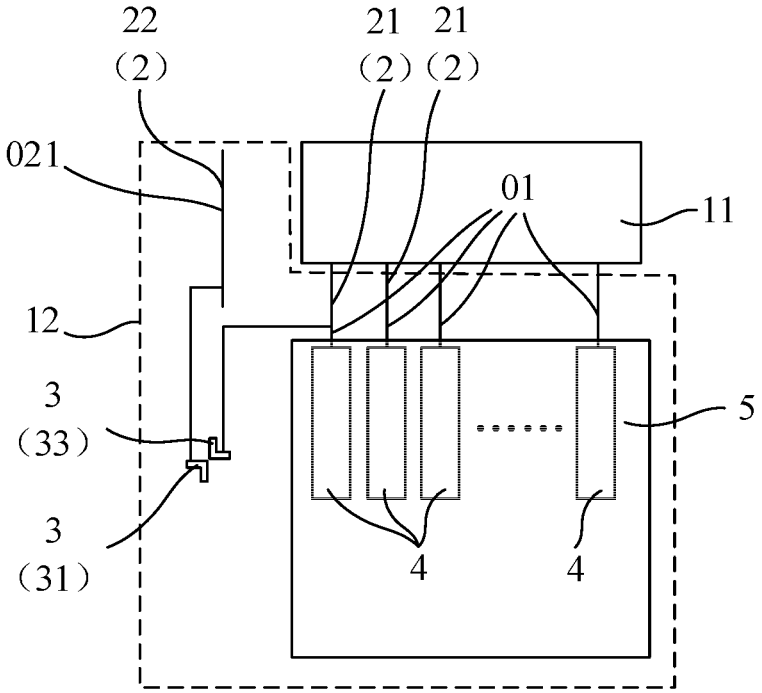
FIG. 11 is a structural schematic diagram of the display panel shown in FIG. 10 when a test circuit board is pressed.

FIG. 10 is another partially enlarged structural schematic diagram of the area B in FIG. 5, and FIG. 11 is a structural schematic diagram of the display panel of FIG. 10 when the test circuit board is pressed. As shown in FIG. 10 and FIG. 11, at least one input signal lead 01 is also electrically connected to a third test pad 33.

During the VT test, the actual signal on the corresponding input signal lead 01 can also be acquired by the third test pad 33, so as to determine the difference between this signal and the preset input signal. Compared with the related art, it is unnecessary to provide a corresponding test pad on the test circuit board, thereby improving the accuracy of the actual feedback signal of the input signal acquired in the VT test.

Figure 12:
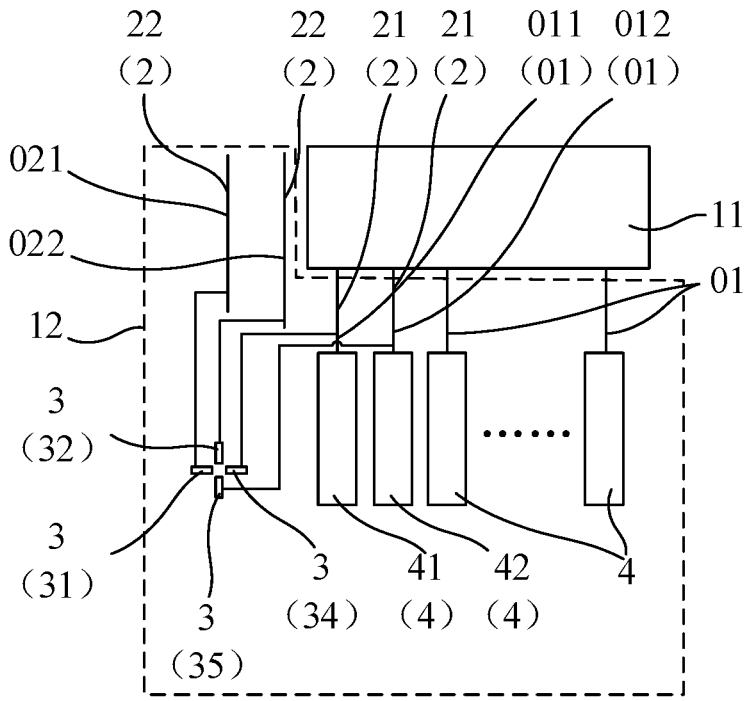
FIG. 12 is yet another partially enlarged structural schematic diagram of the area B shown in FIG. 5.
Figure 13:
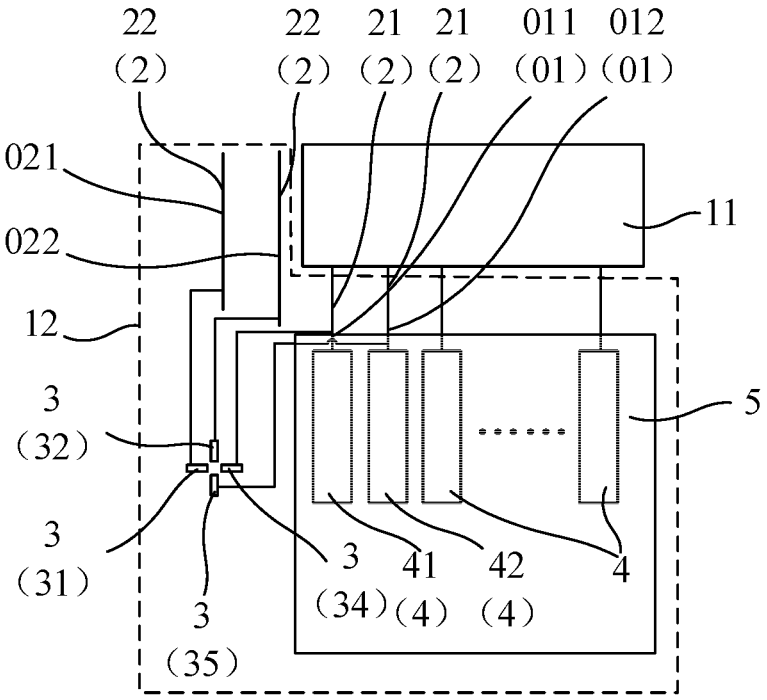
FIG. 13 is a structural schematic diagram of the display panel shown in FIG. 12 when a test circuit board is pressed.

FIG. 12 is a partially enlarged structural schematic diagram of the area B of FIG. 5, and FIG. 13 is a structural schematic diagram of the display panel of FIG. 12 when the test circuit board is pressed. As shown in FIG. 12 and FIG. 13, the input signal lead 01 includes a first input lead 011 and a second input lead 012, and the test circuit board pin 4 includes a first pin 41 and a second pin 42. The first input lead 011 is electrically connected to the first pin 41, and the second input lead 012 is electrically connected to the second pin 42. The first input lead 011 is also electrically connected to a fourth test pad 34, and the second input lead 012 is also electrically connected to a fifth test pad 35. The first test pad 31, the second test pad 32, the fourth test pad 34, and the fifth test pad 35 are spaced apart and reused as the same circuit board alignment mark.

As shown in FIG. 12 and FIG. 13, the first test pad 31, the second test pad 32, the fourth test pad 34, and the fifth test pad 35 are all line segments. An end of each line segment faces the same point, and any two adjacent line segments form a perpendicular angle. That is, the first test pad 31, the second test pad 32, the fourth test pad 34, and the fifth test pad 35 form a cross-shaped alignment mark, which can effectively achieve the alignment function.

Figure 14:
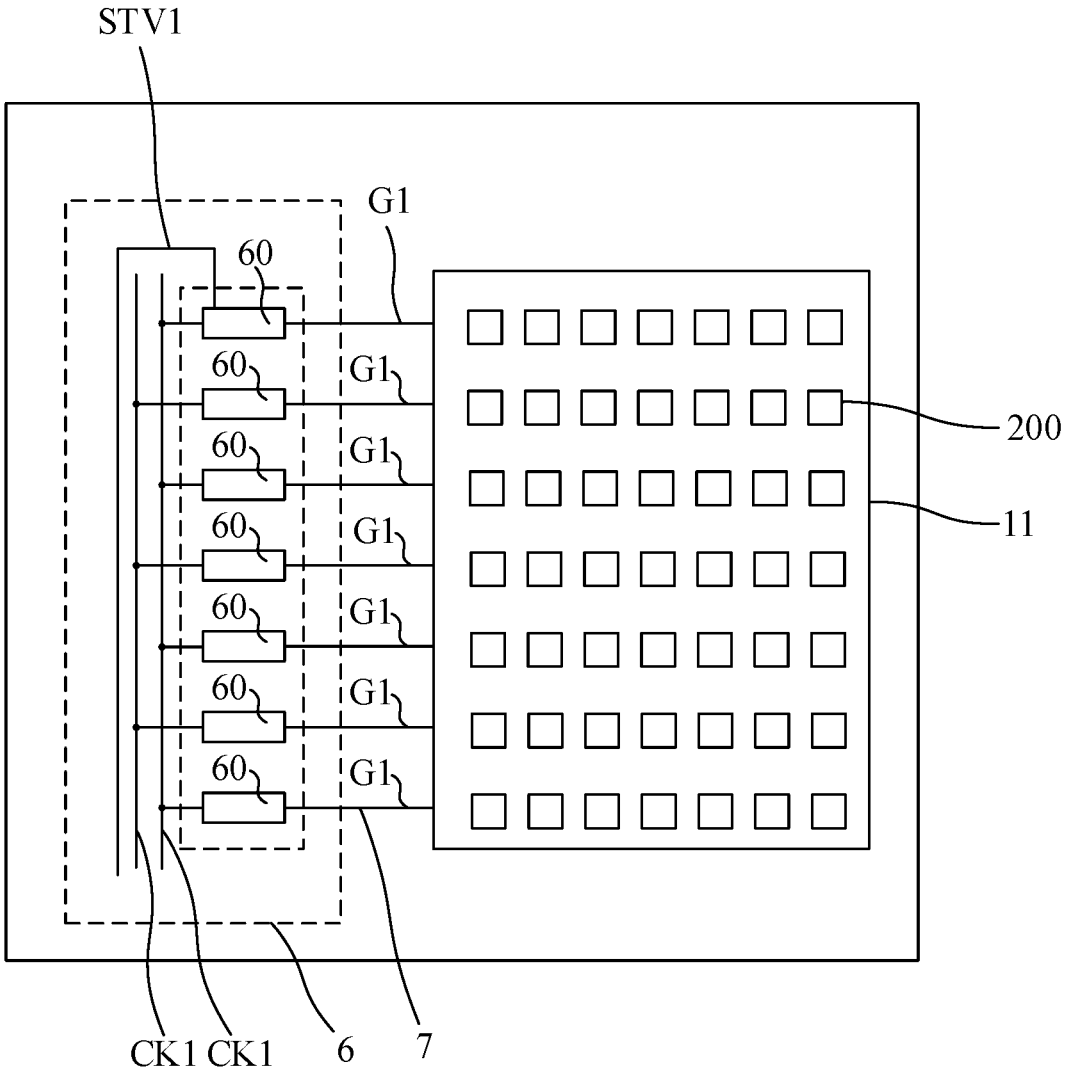
FIG. 14 is a structural schematic diagram of a display panel according to another embodiment of the present disclosure.

FIG. 14 is a structural schematic diagram of another display panel according to an embodiment of the present disclosure. As shown in FIG. 14, the display panel further includes a scan driving circuit 6. The scan driving circuit 6 includes a scan output signal line 7, and the test point lead 22 (not shown in FIG. 14) is electrically connected to the scan output signal line 7.

The scan driving circuit is configured to provide a scan signal, such that the pixels in the display panel are driven to be charged according to the scan signal output by the scan driving circuit. Therefore, during the VT test, the output signal of the scan driving circuit is acquired by the test pad 3 outside the test circuit board 5, and at the same time, under the control of the input signal, the display defect can be further diagnosed.

Figure 15:
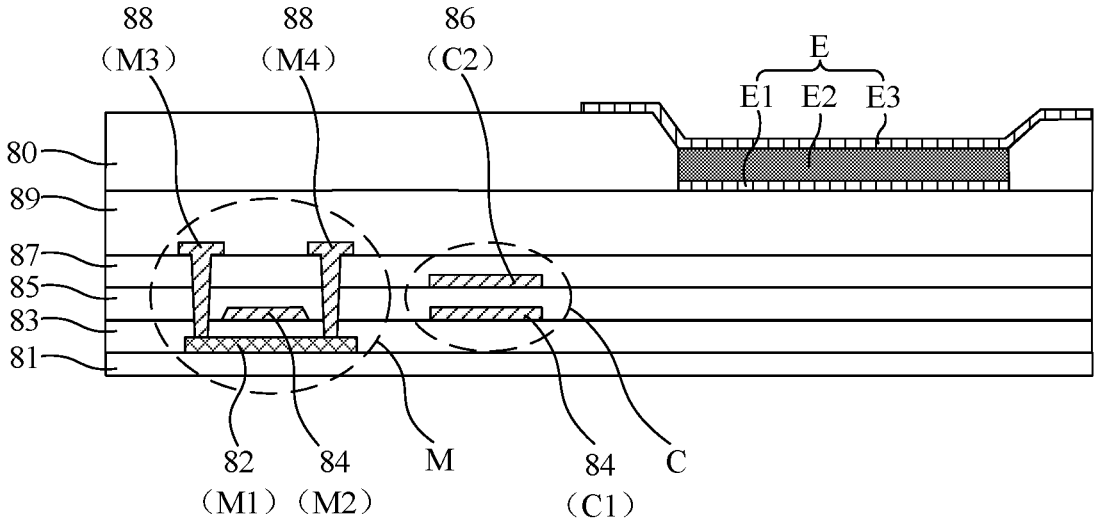
FIG. 15 is a cross-sectional view of a partial area of an organic light-emitting display panel according to an embodiment of the present disclosure.
Figure 16:
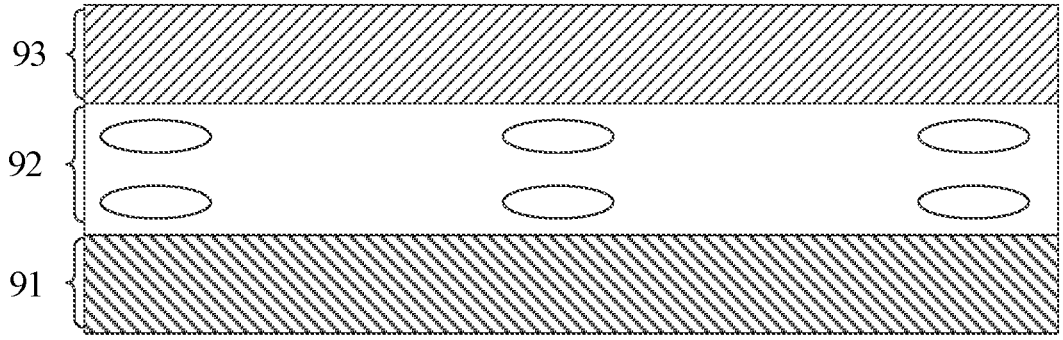
FIG. 16 is a cross-sectional view of a partial area of a liquid crystal display panel according to an embodiment of the present disclosure.

FIG. 15 is a cross-sectional structural schematic diagram of a partial area of an organic light-emitting display panel according to an embodiment of the present disclosure. The display panel is an organic light-emitting display panel. For example, as shown in FIG. 15, the display panel includes a buffering layer 81, a semiconductor layer 82, a gate insulating layer 83, a gate metal layer 84, a first interlayer insulating layer 85, a capacitor metal layer 86, a second interlayer insulating layer 87, a source-drain metal layer 88, a planarization layer 89, and a pixel defining layer 80. The mentioned layers are sequentially stacked in the display area in a direction perpendicular to a plane of the organic light-emitting display panel. The display panel further includes a pixel driving circuit and a light-emitting device E. The pixel driving circuit is configured to drive the light-emitting device E, and includes a thin film transistor M and a storage capacitor C. The thin film transistor M includes an active layer M1, a gate M2, a source M3 and a drain M4. The active layer M1 is located in the semiconductor layer 82. The gate M2 is located in the gate metal layer 84. The source M3 and the drain M4 are located in the source-drain metal layer 88. The storage capacitor C includes a first electrode plate C1 located in the gate metal layer 84, and a second electrode plate C2 located in the capacitor metal layer 86. The pixel defining layer 80 is provided with opening corresponding to the light-emitting device E. The light-emitting device E includes an anode E1, an organic light-emitting layer E2 and a cathode E3 that are stacked in a sequence. Under a voltage applied to the anode E1 and the cathode E3, holes and electrons will be injected into the organic light-emitting layer E2 and recombined in the organic light-emitting layer E2, such that energy is released to realize light-emitting. It should be noted that, in other implementable embodiments, the display panel can also be other types of display panels such as a liquid crystal display panel. An example is shown in FIG. 16, which is a cross-sectional structural diagram of a partial area of a liquid crystal display panel according to an embodiment of the present disclosure. The liquid crystal display panel includes an array substrate 91, a liquid crystal layer 92, and a color filter 93. The color filter 93 is used for a color filter function, so that the display panel can display color image. Scan output signal lines and data lines intersect in an electrically isolating manner to define sub-pixels on array substrate 91. Under the effect of the scan signal output by the scan output signal line, the data line charge each pixel electrode corresponding to each sub-pixel to generate an electric field between the pixel electrode and the common electrode. In this way, liquid crystals in the liquid crystal layer 92 are deflected to display a corresponding gray scale, thereby realizing an image display function.

The specific structure and features of the embodiments of the present disclosure will be described below with respect to the specific structure of the organic light-emitting display panel.

Figure 17:
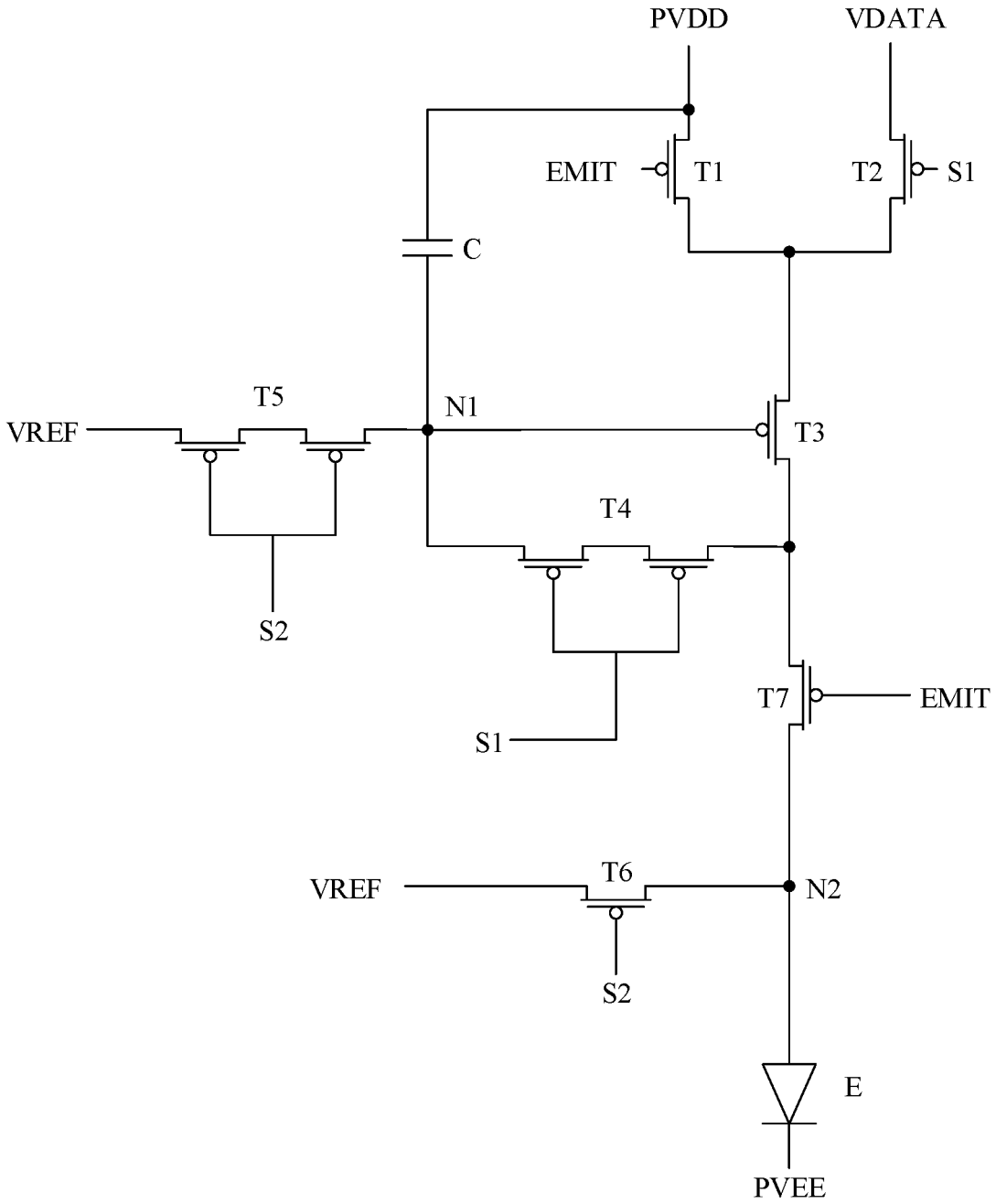
FIG. 17 is a structural schematic diagram of a pixel driving circuit shown in FIG. 14.

FIG. 17 is a structural schematic diagram of a pixel driving circuit of FIG. 14. As shown in FIG. 14 and FIG. 17, the organic light-emitting display panel further includes a pixel driving circuit 200 and a scan driving circuit 6. The pixel driving circuit 200 is located in the display area 11, and includes a data voltage signal line VDATA, a light-emitting device power voltage signal line PVDD, and a reference voltage signal line VREF. The pixel driving circuit 200 further includes: a first transistor T1 having a first terminal electrically connected to the light-emitting device power voltage signal line PVDD, a second terminal, and a control terminal electrically connected to the light-emitting control signal terminal EMIT; a second transistor T2 having a first terminal electrically connected to the data voltage signal line VDATA, a second terminal electrically connected to the second terminal of the first transistor T1, and a control terminal electrically connected to the first scan signal terminal S1; a third transistor T3 having a first terminal electrically connected to the second terminal of the first transistor T1, a second terminal, and a control terminal electrically connected to a first node N1; a fourth transistor T4 having a first terminal electrically connected to the first node N1, a second terminal electrically connected to the second terminal of the third transistor T3, and a control terminal electrically connected to the first scan signal terminal S1; a fifth transistor T5 having a first terminal electrically connected to the reference voltage signal line VREF, a second terminal electrically connected to the first node N1, and a control terminal electrically connected to the second scan signal terminal S2; a sixth transistor T6 having a first terminal electrically connected to the reference voltage signal line VREF, a second terminal electrically connected to the corresponding second node N2, and a control terminal electrically connected to the second scan signal terminal S2; a seventh transistor T7 having a first terminal electrically connected to the second end of the third transistor T3, a second terminal electrically connected to the second node N2, and a control terminal electrically connected to the first scan signal terminal S1; and a storage capacitor C having a first end electrically connected to the light-emitting device power voltage signal line PVDD, and a second end electrically connected to the first node N1. The light-emitting device E has an anode electrically connected to the second node N2, and a cathode electrically connected to the negative voltage power terminal PVEE. The pixel driving circuit is configured to drive the light-emitting device E to emit light, and the light-emitting device power voltage signal line PVDD is configured to provide the light-emitting device E with a required bias voltage. The reference voltage signal line VREF is configured to provide a required reference voltage for the pixel driving circuit to implement a reset function of the node in the pixel driving circuit. The scan driving circuit 6 includes an initial first input signal line STV1, a first clock signal line CK1, and a first scan output signal line G1. The scan driver circuit is composed of cascaded shift registers 60, in which a previous stage of shift register provides an input signal for a next stage of shift register. Therefore, for the first stage shift register 60, a driving chip is required to provide an initial input signal. When performing VT test, it is required to provide this signal from outside. The initial first input signal line STV1 is the signal line corresponding to the input terminal of the first stage shift register 60 in the scan driving circuit. The first clock signal line CK1 is a clock signal line required for the scan driving circuit, and there may be two first clock signal lines CK1. The input signal lead 01 is electrically connected to the data voltage signal line VDATA, the light-emitting device power voltage signal line PVDD, the reference voltage signal line VREF, the initial first input signal line STV1 or the first clock signal line CK1. When performing VT test, the test circuit board 5 provides an input test signal through the input signal lead 01 to drive the display panel to work normally; the first output test lead 021 is electrically connected to the first scan output signal line G1. It should be noted that the scan driving circuit 6 includes a plurality of first scan output signal lines G1, and the first output test lead 021 only needs to be electrically connected to one of the plurality of first scan output signal lines G1. When performing VT test, the signal of the first scan output signal line G1 is acquired by the first test pad 31, and the defect of the display panel can be further diagnosed in conjunction with the specific input test signal and the pixel lighting state of the display panel.

Figure 18:
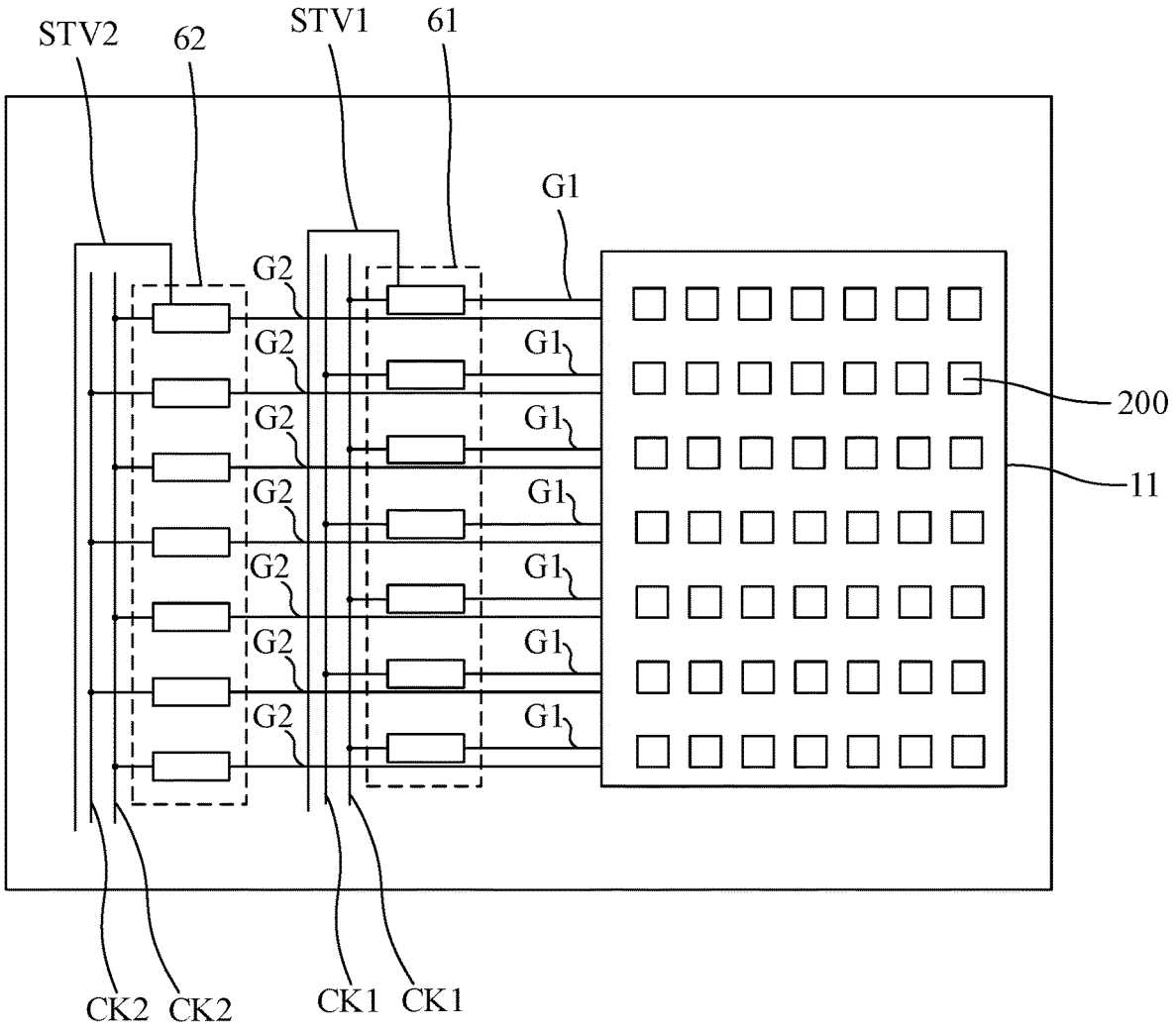
FIG. 18 is a structural schematic diagram of a display panel according to yet another embodiment of the present disclosure.
Figure 19:
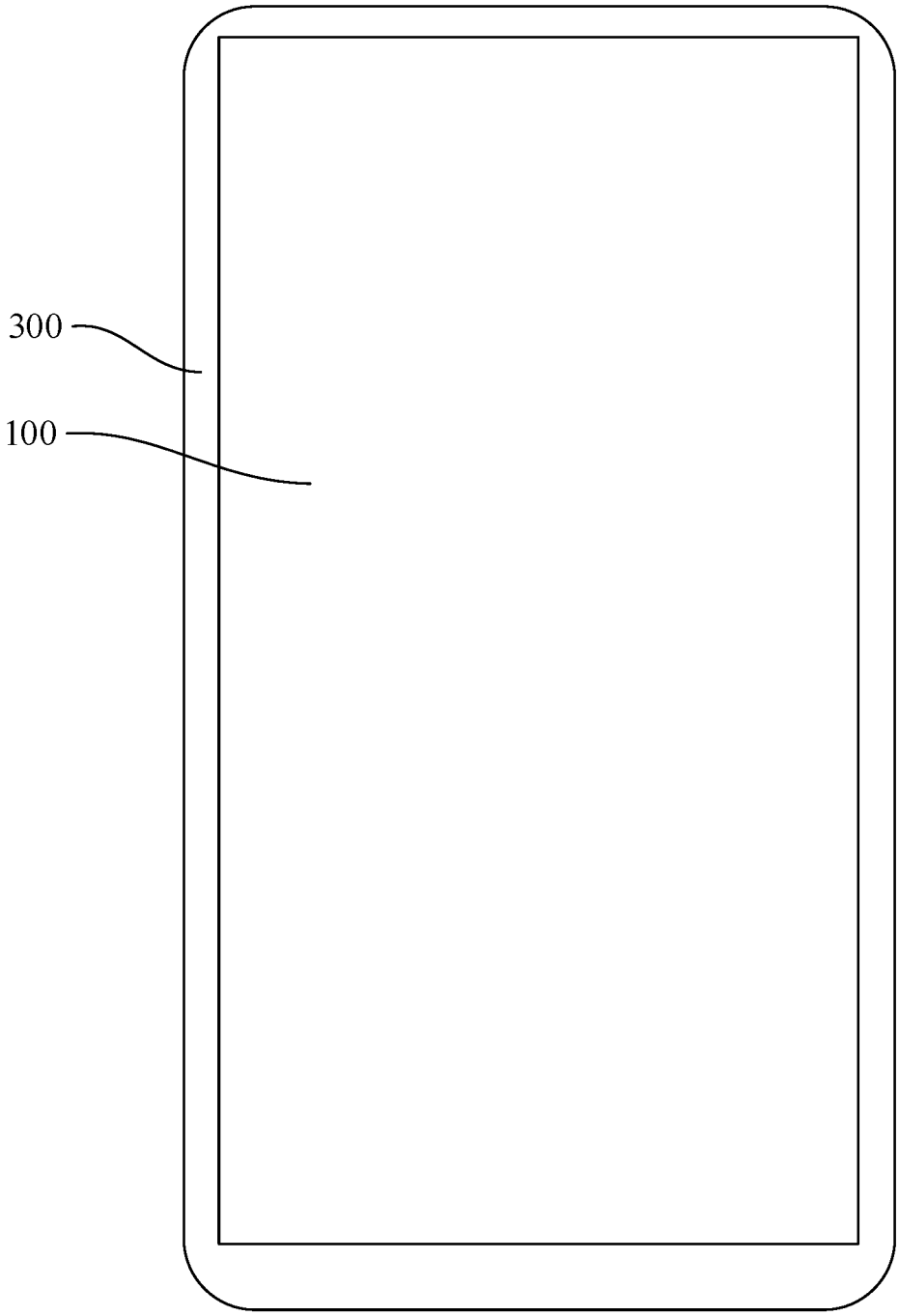
FIG. 19 is a structural schematic diagram of a display apparatus according to an embodiment of the present disclosure.

FIG. 18 is a structural schematic diagram of another display panel according to an embodiment of the present disclosure. The display panel is an organic light-emitting display panel, and further includes a pixel driving circuit 200, a charging scan driving circuit 61, and a light-emitting control scan driving circuit 62. The pixel driving circuit 200 includes a data voltage signal line VDATA, a light-emitting device power voltage signal line PVDD, and a reference voltage signal line VREF. The charging scan driving circuit 61 includes an initial first input signal line STV1, a first clock signal line CK1 and a first scan output signal line G1. The light-emitting control scan driving circuit 62 includes a second initial input signal line STV2, a second clock signal line CK2, and a second scan output signal line G2. The input signal lead 01 is electrically connected to the data voltage signal line VDATA, the light-emitting device power voltage signal line PVDD, the reference voltage signal line VREF, the initial first input signal line STV1, the first clock signal line CK1, the second initial input signal line STV2, or the second clock signal line CK2. The first output test lead 021 is electrically connected to the first scan output signal line G1, and the second output test lead 022 is electrically connected to the second scan output signal line G2.

The organic light-emitting display panel includes two kinds of scan driving circuits, i.e., the charging scan driving circuit 61 and the light-emitting control scan driving circuit 62. The charging scan driving circuit 61 is configured to control the pixel driving circuit 200 to perform a scan charging, i.e., providing signals for the first scan signal terminal S1 and the second scan signal terminal S2 in the pixel driving circuit 200. The light-emitting control scan driving circuit 62 is configured to control the light-emitting device to emit light or not, i.e., providing a signal for the light-emitting control signal terminal EMIT in the pixel driving circuit 200. Therefore, in order to diagnose the defect of the display panel with higher accuracy, it is necessary to provide the first output test lead 021 and the second output test lead 022 that are configured to respectively test the output signal of the charging scan driving circuit and the output signal of the light-emitting control scan driving circuit.

It should be noted that, in various embodiments of the present disclosure, the test circuit board 5 is only used during the VT test. Once the VT test is completed, the test circuit board is removed from the display panel, and then the driving chip is bound. That is, the test circuit board is not included in a finished display panel product.

The embodiments of the present disclosure further provide a display apparatus. FIG. 18 is a structural schematic diagram of a display apparatus according to an embodiment of the present disclosure. As shown in FIG. 18, the display apparatus includes a display panel 100, and a frame 300 disposed at a position corresponding to the non-display area of the display panel 100.

The specific structure of the display panel 100 is the same as that according to any of the above embodiments, which will not be described herein again. The display apparatus can be an electronic apparatus having a display function such as a mobile phone, a tablet computer, a notebook computer, an electronic paper book, or a television.

In the display apparatus according to the embodiment of the present disclosure, since a part of the test leads is used as a test point lead electrically connected to a test pad integrated on the display panel, and at the same time, the test pad is reused as a circuit board alignment mark, it is unnecessary to provide an additional test pad on the test circuit board, and the test signal can be acquired by the test pad outside the circuit board, such that the test signal is no longer acquired through the test circuit board. In this way, the accuracy of the test signal acquired in the VT test is improved. In addition, since at least a part of the test pad and the lines are directly provided on the display panel, the complexity and space required for the wirings in the test circuit board are reduced. Further, since the test pad is reused as a circuit board alignment mark, there is no need to provide a corresponding test circuit board pin on the display panel, thereby reducing the space occupied by the test circuit board on the display panel.

The above-described embodiments are merely the preferred embodiments of the present disclosure, which are not intended to provide limitation. Any modification, equivalent substitution, improvement made within the spirit and scope of the present disclosure shall fall into the scope of the present disclosure.

Finally, it should be noted that the above embodiments are merely used to illustrate the technical solutions of the present disclosure, and are not limited thereto. Although the present disclosure has been described in detail with reference to the foregoing embodiments, those skill in the art should understand that the technical solutions described in the foregoing embodiments can be modified, or some or all of the technical features can be substituted. However, these modifications or substitutions should not detract the essence of the corresponding technical solutions from the protection scope of the present disclosure.

What is claimed is:

1. A display panel having a non-display area and a display area, the display panel comprising a base substrate, wherein the base substrate is provided with a plurality of test leads in the non-display area, the plurality of test leads comprising a circuit board lead and a test point lead, and wherein the base substrate is further provided with a test pad and a test circuit board pin in the non-display area, the test circuit board pin being electrically connected to the circuit board lead, the test pad being electrically connected to the test point lead, wherein the test pad is configured for providing an output test signal of the display panel and reused as a circuit board alignment mark, and wherein the circuit board alignment mark is configured to align the test circuit board pin against a test circuit board that is pressed to the test circuit board pin for testing.

2. The display panel according to claim 1, wherein the circuit board lead comprises an input signal lead, the test point lead comprises a first output test lead, the test pad comprises a first test pad, and the first output test lead is electrically connected to the first test pad.

3. The display panel according to claim 2, wherein the circuit board lead further comprises a second output test lead.

4. The display panel according to claim 2, wherein the test point lead further comprises a second output test lead, the test pad further comprises a second test pad, and the second output test lead is electrically connected to the second test pad.

5. The display panel according to claim 4, wherein the first test pad and the second test pad are spaced apart and reused as one circuit board alignment mark.

6. The display panel according to claim 5, wherein the first test pad comprises a first line segment and a second line segment, and wherein the first line segment and the second line segment being connected to one another at ends thereof and forming a perpendicular angle, wherein the second test pad comprises a third line segment and a fourth line segment, the third line segment and the fourth line segment being connected to one another at ends thereof and forming a perpendicular angle, and the perpendicular angle of the first test pad is opposite to the perpendicular angle of the second test pad.

7. The display panel according to claim 4, wherein the input signal lead comprises a first input lead and a second input lead, the test circuit board pin comprises a first pin and a second pin, the first input lead is electrically connected to the first pin, and the second input lead is electrically connected to the second pin;

the first input lead is further electrically connected to a fourth test pad, and the second input lead is further electrically connected to a fifth test pad; and the first test pad, the second test pad, the fourth test pad, and the fifth test pad are spaced apart from one another and reused as one circuit board alignment mark.

8. The display panel according to claim 7, wherein the first test pad, the second test pad, the fourth test pad, and the fifth test pad are all line segments, ends of which face a same point, and any two adjacent of which form a perpendicular angle.

9. The display panel according to claim 1, further comprising a scan driving circuit, wherein the scan driving circuit comprises a scan output signal line, and wherein the test point lead is electrically connected to the scan output signal line.

10. The display panel according to claim 2, wherein the input signal lead is further electrically connected to a third test pad.

11. The display panel according to claim 2, wherein the display panel is an organic light-emitting display panel.

12. The display panel according to claim 11, further comprising:

a pixel driving circuit comprising a data voltage signal line, a light-emitting device power voltage signal line, and a reference voltage signal line; and a scan driving circuit comprising an initial first input signal line, a first clock signal line, and a first scan output signal line, wherein the input signal lead is electrically connected to the data voltage signal line, the light-emitting device power voltage signal line, the reference voltage signal line, the initial first input signal line, or the first clock signal line, and the first output test lead is electrically connected to the first scan output signal line.

13. The display panel according to claim 4, wherein the display panel is an organic light-emitting display panel, the display panel further comprising:

a pixel driving circuit comprising a data voltage signal line, a light-emitting device power voltage signal line, and a reference voltage signal line;

a charging scan driving circuit comprising an initial first input signal line, a first clock signal line, and a first scan output signal line; and a light-emitting control scan driving circuit comprising a second initial input signal line, a second clock signal line, and a second scan output signal line, wherein the input signal lead is electrically connected to the data voltage signal line, the light-emitting device power voltage signal line, the reference voltage signal line, the initial first input signal line, the first clock signal line, the second initial input signal line, or the second clock signal line, and the first output test lead is electrically connected to the first scan output signal line, and the second output test lead is electrically connected to the second scan output signal line.

14. A display apparatus, comprising a display panel having a non-display area and a display area, the display panel comprising a base substrate, wherein the base substrate is provided with a plurality of test leads in the non-display area, the plurality of test leads comprising a circuit board lead and a test point lead, and wherein the base substrate is further provided with a test pad and a test circuit board pin in the non-display area, the test circuit board pin being electrically connected to the circuit board lead, the test pad being electrically connected to the test point lead, wherein the test pad is configured for providing an output test signal of the display panel and reused as a circuit board alignment mark, and wherein the circuit board alignment mark is configured to align the test circuit board pin against a test circuit board that is pressed to the test circuit board pin for testing.

15. The display apparatus according to claim 14, wherein the circuit board lead comprises an input signal lead, the test point lead comprises a first output test lead, the test pad comprises a first test pad, and the first output test lead is electrically connected to the first test pad.

16. The display apparatus according to claim 15, wherein the test point lead further comprises a second output test lead, the test pad further comprises a second test pad, and the second output test lead is electrically connected to the second test pad.

17. The display apparatus according to claim 16, wherein the first test pad and the second test pad are spaced apart and reused as one circuit board alignment mark.

18. The display apparatus according to claim 16, wherein the input signal lead comprises a first input lead and a second input lead, the test circuit board pin comprises a first pin and a second pin, the first input lead is electrically connected to the first pin, and the second input lead is electrically connected to the second pin;

the first input lead is further electrically connected to a fourth test pad, and the second input lead is further electrically connected to a fifth test pad; and the first test pad, the second test pad, the fourth test pad, and the fifth test pad are spaced apart from one another and reused as one circuit board alignment mark.

19. The display apparatus according to claim 15, wherein the display panel is an organic light-emitting display panel.

20. The display apparatus according to claim 14, wherein the display panel further comprises a scan driving circuit, the scan driving circuit comprises a scan output signal line, and the test point lead is electrically connected to the scan output signal line.

* * * * *